US007822373B2

(12) United States Patent
Maeda

(10) Patent No.: US 7,822,373 B2
(45) Date of Patent: Oct. 26, 2010

(54) DEVELOPER CONVEYING DEVICE AND IMAGE-FORMING APPARATUS WITH ELECTRODES FOR CONVEYING CHARGED DEVELOPER

(75) Inventor: Masataka Maeda, Konan (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 796 days.

(21) Appl. No.: 11/616,541

(22) Filed: Dec. 27, 2006

(65) Prior Publication Data

US 2007/0147904 A1 Jun. 28, 2007

(30) Foreign Application Priority Data

Dec. 28, 2005 (JP) ..... 2005-380150

(51) Int. Cl.
*G03G 15/08* (2006.01)

(52) U.S. Cl. ..... 399/289

(58) Field of Classification Search ..... 399/289
See application file for complete search history.

(56) References Cited

U.S. PATENT DOCUMENTS 6,708,014 B2 * 3/2004 Miyaguchi et al. ..... 399/289

FOREIGN PATENT DOCUMENTS

| | | |
|---|---|---|
| JP | 2002116620 | 4/2002 |
| JP | 2003-043806 | 2/2003 |
| JP | 2003-098820 | 4/2003 |
| JP | 2003-098830 | 4/2003 |
| JP | 2003098826 | 4/2003 |
| JP | 2004205644 | 7/2004 |
| JP | 2005115405 | 4/2005 |

OTHER PUBLICATIONS

Notification of Reasons for Rejection in corresponding Japanese Application No. 2005-380150 mailed on Aug. 3, 2010.

* cited by examiner

*Primary Examiner*—David M Gray
*Assistant Examiner*—Erika Villaluna
(74) *Attorney, Agent, or Firm*—Banner & Witcoff, Ltd

(57) ABSTRACT

A developer conveying device includes a first guide member, a second guide member, and a plurality of electrodes arranged on the first guide member and the second guide member. The first guide member forms a first section of a conveying path of a charged developer. The second guide member forms a second section of the conveying path which continues from the first section of the conveying path. The plurality of electrodes generate a traveling wave electric field that conveys the charged developer along the conveying path. A following rate at which the developer follows travel of the traveling wave electric field in the second section is different from the following rate in the first section.

15 Claims, 19 Drawing Sheets

DEVELOPER CONVEYING DEVICE AND IMAGE-FORMING APPARATUS WITH ELECTRODES FOR CONVEYING CHARGED DEVELOPER

CROSS-REFERENCE TO RELATED APPLICATIONS

This application claims the benefit of Japanese Patent Application No. 2005-380150 filed Dec. 28, 2005 in the Japan Patent Office, the disclosure of which is incorporated herein by reference.

BACKGROUND

This invention relates to a developer conveying device that conveys a charged developer using a traveling wave electric field. The invention also relates to an image forming apparatus including the developer conveying device.

Generally, this type of developer conveying device generates a traveling wave electric field by a plurality of electrodes to convey a charged toner to a photosensitive drum of an image forming apparatus.

SUMMARY

In the above developer conveying device, the toner moves as the traveling wave electric field travels.

Consequently, there are places where toner density is high and low in a moving path of the toner. Due to the irregular density of the toner, an image developed on the photosensitive drum may have irregular thickness. Accordingly, it would be desirable to provide a technique of reducing irregular density of a developer caused by a traveling wave electric field.

One aspect of the present invention provides a developer conveying device including a first guide member, a second guide member, and a plurality of electrodes arranged on the first guide member and the second guide member. The first guide member forms a first section of a conveying path of a charged developer. The second guide member forms a second section of the conveying path which continues from the first section of the conveying path. The plurality of electrodes generate a traveling wave electric field that conveys the charged developer along the conveying path. A following rate at which the developer follows travel of the traveling wave electric field in the second section is different from the following rate in the first section.

Another aspect of the present invention provides an image forming apparatus including the developer conveying device, a carrier on which an electrostatic latent image is formed, and a transfer device that transfers a developer supplied to the carrier to a recording medium.

BRIEF DESCRIPTION OF THE DRAWINGS

The invention will now be described below, by way of example, with reference to the accompanying drawings, in which.

DETAILED DESCRIPTION OF THE PREFERRED EMBODIMENT

Figure 1:
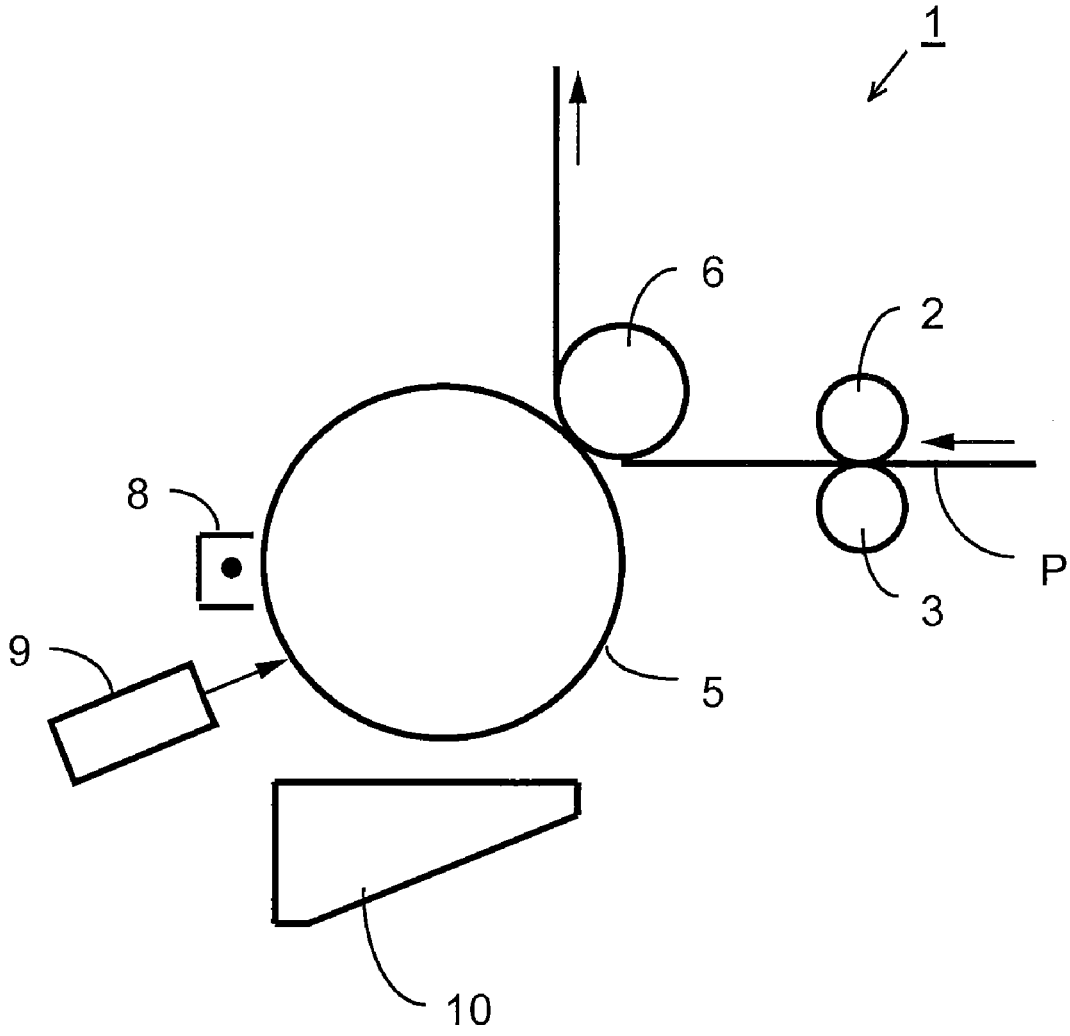
FIG. 1 is a partial diagrammatic view schematically showing a constitution of a main part of a laser printer according to the present invention.

Referring to FIG. 1, a laser printer 1 includes resist rollers 2 and 3 that arbitrarily lock a front end of paper P supplied sheet by sheet from a not shown feeding tray. The resist rollers 2 and 3 convey the locked paper P so that the paper P passes through between a photosensitive drum 5 and a transfer roller 6 at a predetermined timing.

A drum body 5*a* (see FIG. 2) of the photosensitive drum 5 is electrically grounded. A positively charged photosensitive layer 5*b* (see FIG. 2), made of organic photoreceptor material like polycarbonate, is provided on the surface of the photosensitive drum 5. The photosensitive drum 5 is supported to the laser printer 1 in such a manner as to be rotated counterclockwise in FIG. 1.

A charger 8, a laser scanner unit 9, and a developing unit 10, are arranged around the photosensitive drum 5 from upstream in a rotational direction of the photosensitive drum 5. The charger 8 is a scorotron type charger for positive charging. The charger 8 generates a corona discharge from a charging wire such as tungsten, and uniformly charges the surface of the photosensitive drum 5. The laser scanner unit 9 is a well known type which emits a laser beam corresponding to externally inputted image data from a light source, and performs laser light scanning with a mirror surface of a rotationally driven polygon mirror to irradiate the surface of the photosensitive drum 5. The developing unit 10 is arranged below the photosensitive drum 5. The developing unit 10 supplies positively charged toner T to the surface of the photosensitive drum 5.

The surface of the photosensitive drum 5 is uniformly charged by the charger 8 in accordance with the rotation of the photosensitive drum 5. Then, the surface of the photosensitive drum 5 is exposed by rapid scanning of the laser beam from the laser scanner unit 9. As a result, an electrostatic latent image corresponding to the image data is formed on the surface of the photosensitive drum 5.

Subsequently, the developing unit 10 supplies the positively charged toner T to the photosensitive drum 5. The toner T is supplied to the electrostatic latent image formed on the surface of the photosensitive drum 5, that is, to a low electric potential area exposed to the laser beam. The toner T is carried on the low electric potential area to form a toner image (visual image).

The transfer roller 6 is supported to the laser printer 1 in such a manner as to be rotated clockwise in FIG. 1. The transfer roller 6 has a roller made from ion conductive rubber material and a metal roller shaft covered by the roller. A transfer bias (transfer forward bias) is applied to the transfer roller 6 from a transfer bias power source at the time of transfer. Accordingly, the toner image carried on the surface of the photosensitive drum 5 is transferred onto the paper P while the paper P passes between the photosensitive drum 5 and the transfer roller 6. Although not shown, the paper P after the transfer of the toner image is conveyed to a not shown fixing unit having a heat roller and a pressure roller. The paper P is discharged to a not shown discharge tray after the toner image is fixed by heat.

Figure 2:
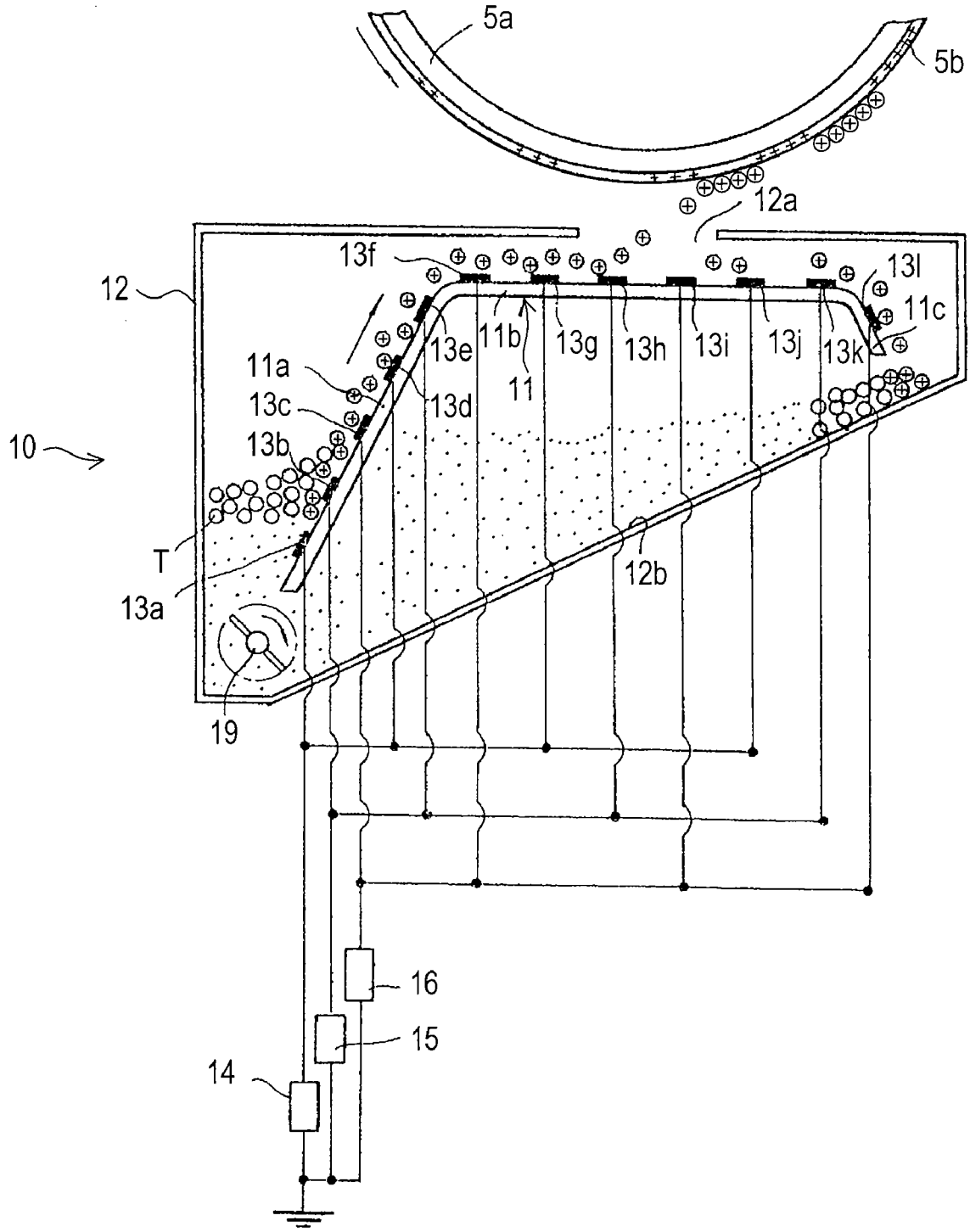
FIG. 2 is a cross sectional view showing a constitution of a developing unit of the laser printer in detail.

Referring to FIG. 2, the developing unit 10 is provided with a container 12 that houses the toner T therein. A conveying member 11 that guides the toner T is also provided inside the container 12. In the present embodiment, the toner T is a non-magnetic single component polymerized toner. The container 12 is formed into a box-like shape, and has an opening 12*a* and a slant bottom surface 12*b*. The opening 12*a* opens in a section facing the photosensitive drum 5.

The conveying member 11 includes a long slant portion 11*a*, a horizontal portion 11*b*, and a short slant portion 11*c*. The long slant portion 11*a* slantingly extends in a direction toward the lower end of the bottom surface 12*b*. One end of the horizontal portion 11*b* is continuous with the top end of the long slant portion 11*a*. The horizontal portion lib horizontally extends over an area below the opening 12*a*. The short slant portion 11*c* is continuous with the other end of the horizontal portion 11*b*, and extends slantingly downward.

Figure 3:
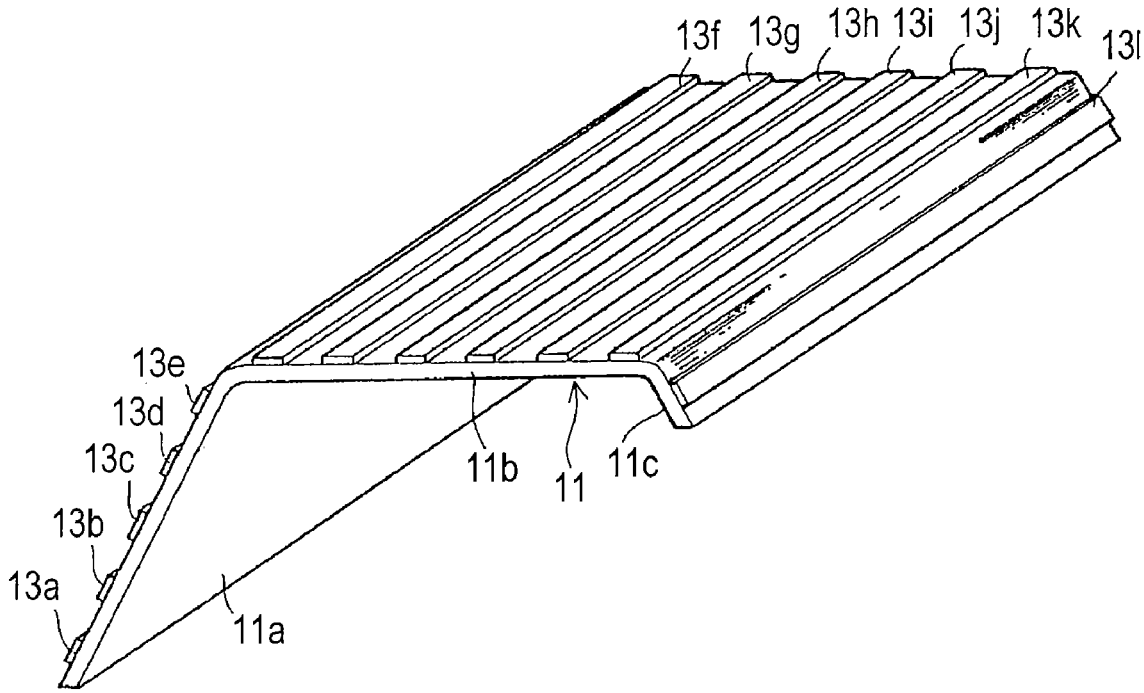
FIG. 3 is a perspective view showing a constitution of a conveying member of the developing unit.

As shown in FIGS. 2 and 3, a plurality of linear electrodes 13*a* to 13*l* are arranged spaced apart from each other on the upper surface of the conveying member 11, from the lower end of the long slant portion 11*a* to the lower end of the short slant portion 11*c*. The linear electrodes 13*a* to 13*l* are disposed in the order of 13*a*, 13*b*, . . . , starting from the lower end of the long slant portion 11*a*. Each of the linear electrodes 13*a* to 13*l* has the same width (in a direction perpendicular to the surface of FIG. 2 drawing) as the width of the conveying member 11. As seen in FIG. 2, alternating current sources 14, 15 and 16 are sequentially connected to every two of the linear electrodes 13*a* to 13*l*. Specifically, the linear electrodes 13*a*, 13*d*, 13*g* and 13*j* are connected to alternating current source 14. The linear electrodes 13*b*, 13*e*, 13*h* and 13*k* are connected to alternating current source 15. The linear electrodes 13*c*, 13*f*, 13*i* and 13*l* are connected to alternating current source 16. Accordingly, when the alternating current sources 14, 15 and 16 apply alternating voltages whose phases are shifted from each other, e.g., by 120° (2π/3), to the electrodes 13*a* to 13*l*, a traveling wave electric field is formed on the conveying member 11.

Also, an agitator 19 that agitates the toner T is provided in the vicinity of the lower end of the bottom surface 12*b* of the container 12. Moreover, the lower end of the long slant portion 11*a* is inserted into the toner T accumulated in the vicinity of the agitator 19. Therefore, in the developing unit 10, the toner T is frictionally charged to positive polarity by the agitator 19 and conveyed directly below the opening 12*a* by the traveling wave electric field formed on the conveying member 11. The toner T is then supplied to the photosensitive drum 5 through the opening 12*a*.

Figure 4:
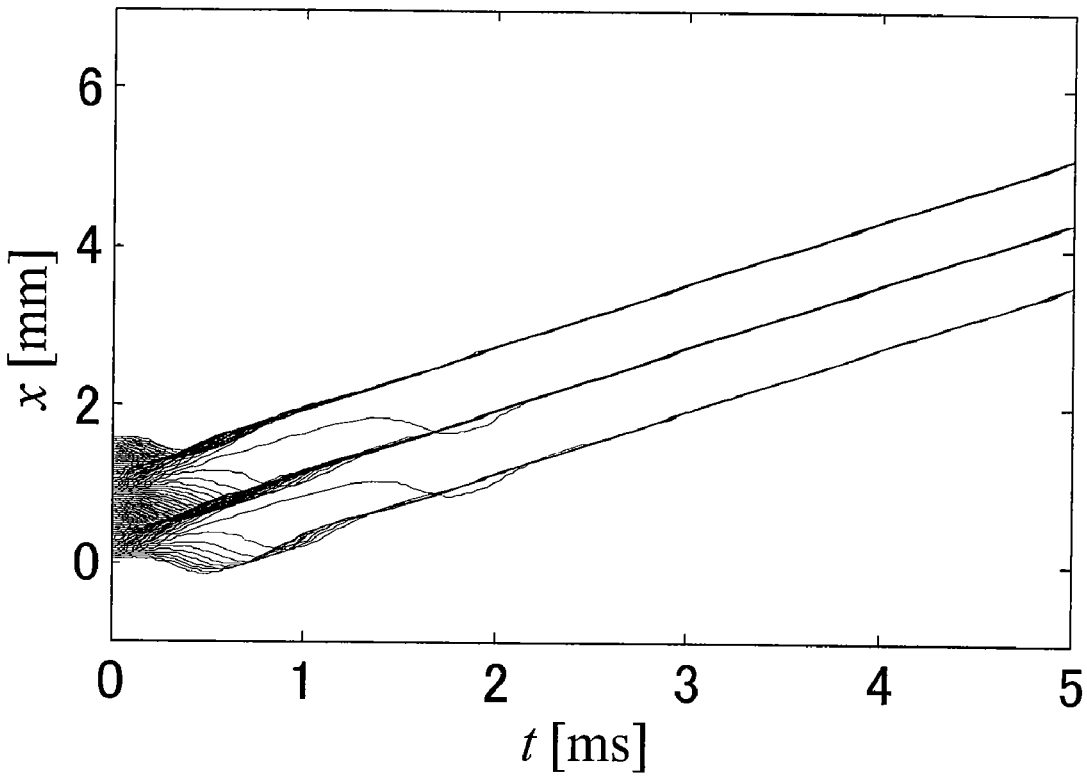
FIG. 4 is a graph chart showing behavior of toner under general conditions.

Here, a layer of the toner T formed on the conveying member 11 is extremely thin. Therefore, assuming that the motion of the toner T is one dimensional, and a length of each of the linear electrodes 13*a* to 13*l* in a toner conveying direction is equal to zero (0), a traveling wave electric field function E(x) and an equation of motion of the toner T can be expressed as follows.

$$E(x) = E_0 \sin[k(x - vt)] \tag{1}$$

$$\text{where } k = \frac{2\pi}{\lambda},$$

$$v = \lambda f$$

$$m\frac{d^2x}{dt^2} + 6\pi\eta a\frac{dx}{dt} = qE \tag{2}$$

where $E_0$: field intensity, x: distance from the linear electrode 13 in the conveying direction, k: wave number per unit distance, v: velocity, λ: wavelength, f: frequency of electric field, m: mass of one toner particle, η: viscosity coefficient of air, a: radius of one toner particle, and q: electric charge of one toner particle Now, if values, $E_0=3\times10^6$ [V/m], λ=0.8 [mm], f=300 [Hz], $m=6.28\times10^{-13}$ [kg], $\eta=1.82\times10^{-5}$ [Pa·s], a=10 [μm], and $q=1.89\times10^{-14}$ [C] are substituted to the above expressions (1) and (2), results as shown in FIG. 4 can be obtained. FIG. 4 shows behavior of the toner T, when the toner T is uniformly placed in a position from x=0 to 1.6 mm (for two wavelengths) as an initial position.

As seen from FIG. 4, the toner T is uniformly dispersed at first. Then, the toner T is gradually gathered and forms rows of stripe pattern with intervals corresponding to the wavelength of the traveling wave electric field to be moved at a traveling velocity of the traveling wave electric field. That is, the toner T follows travel of the traveling wave electric field. In practice, the rows of the toner T are a little more widened due to electrostatic repulsion which interacts between the particles of the toner T. However, the repulsion is not considered in the above calculation. Also in FIG. 4, the conveying member 11 is assumed to be horizontal from the lower end of the long slant portion 11*a* to the lower end of the short slant portion 11*c* in order to simplify calculation formulas.

When the toner T is conveyed in rows of stripe pattern on the conveying member 11 as such, an image developed with the toner T may include irregular thickness of stripe pattern. Accordingly, the inventor of the present invention keenly examined how the irregular density, caused by the traveling wave electric field, of the toner T is decreased on the conveying member 11.

As a result, the inventor found that decrease in irregular density of the toner T can be achieved by changing a following rate at which the toner T follows travel of the traveling wave electric field. That is, a conveying force on the toner T is decreased to be smaller than a resisting force to the conveying force so that the following expression is satisfied, for example.

$$1 > \frac{qE}{6\pi\eta a \cdot f_d \lambda} \tag{3}$$

From now on, particular embodiments will be described. In the following embodiments, the conveying member 11 is assumed to be horizontal as described above for the purpose of simplifying calculation formula. Nevertheless, similar results are expected in the actual conveying member 11 as shown in FIG. 3.

First Embodiment

Figure 5:
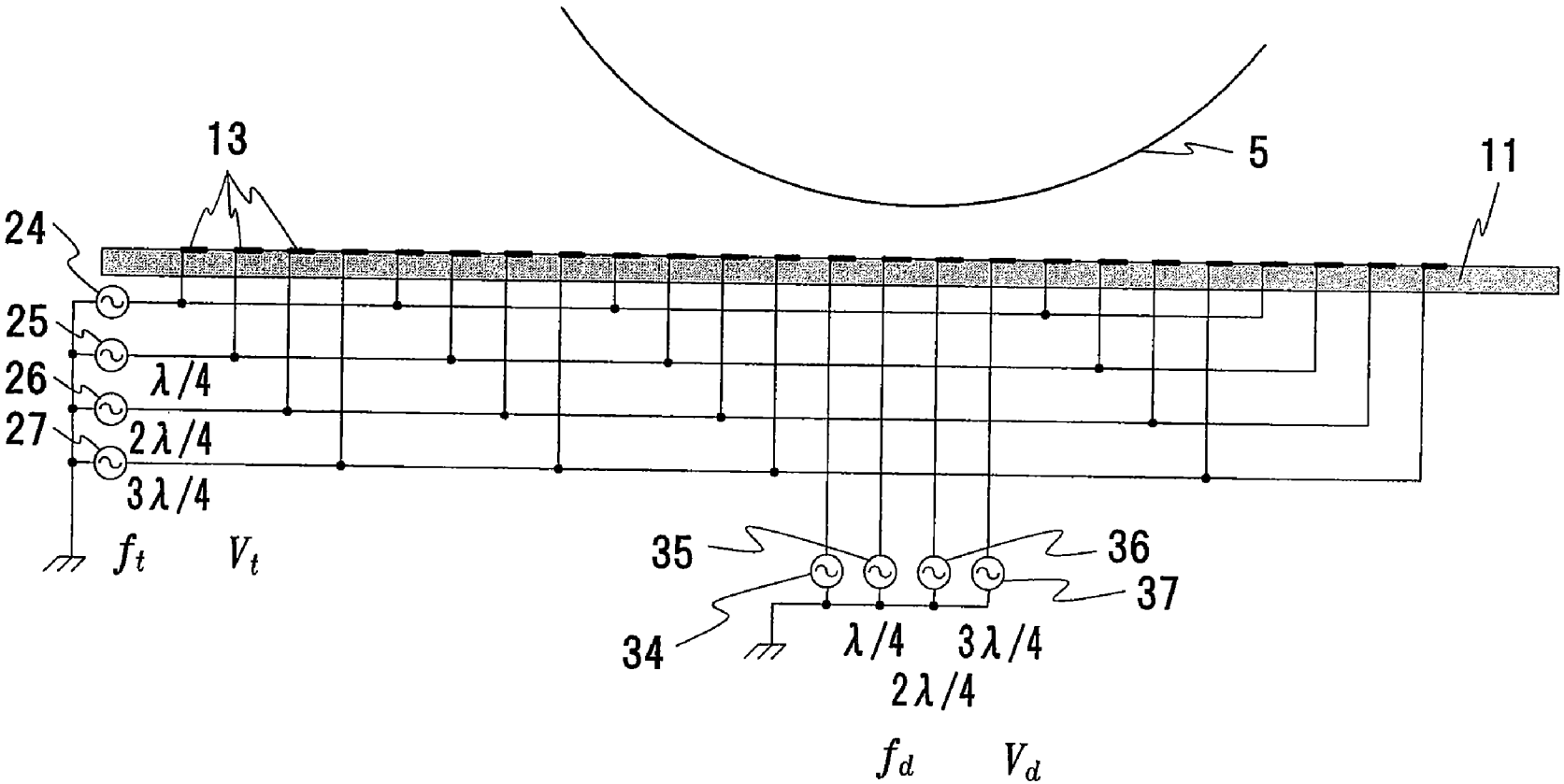
FIG. 5 is an explanatory view simplistically showing a mechanism of conveying toner according to first and second embodiments.

Referring to FIG. 5, the linear electrodes 13 are provided on the conveying member 11 at regular intervals in the present embodiment. The toner T is conveyed from left to right in FIG. 5. Alternating voltages (voltage $V_t$, frequency $f_t$, sine wave) as shown in FIG. 7A are applied to the linear electrodes 13 provided in the conveying section (left and right portions excluding the center portion of the conveying member 11) by alternating current sources 24, 25, 26 and 27. The alternating voltages generated by the alternating current sources 24 to 27 are shifted in phase by 90° (π/2) in the order of the alternating current sources 24 to 27. Also, alternating voltages (voltage $V_d$, frequency $f_d$, sine wave) as shown in FIG. 7B are applied to the linear electrodes 13 provided in the developing section (the center portion of the conveying member 11; part of the conveying member 11 facing the photosensitive drum 5 and thus, the part most close to the photosensitive drum 5 and its vicinity) by alternating current sources 34, 35, 36 and 37. The alternating voltages generated by the alternating current sources 34 to 37 are shifted in phase by 90° (π/2) in the order of the alternating current sources 34 to 37. Now, assuming that $V_t=V_d=300$ [V], $f_t=400$ [Hz], $f_d=4$ k [Hz], interelectrode distance=0.2 [mm], electrode length=20 [μm], and further providing an X coordinate along the conveying direction of the toner T such that the developing section (i.e., part where frequency $f_d$ is applied) is positioned where x=4 to 5 mm, calculation results shown in FIG. 6 are obtained by calculating the above expressions (1) and (2).

Figure 6:
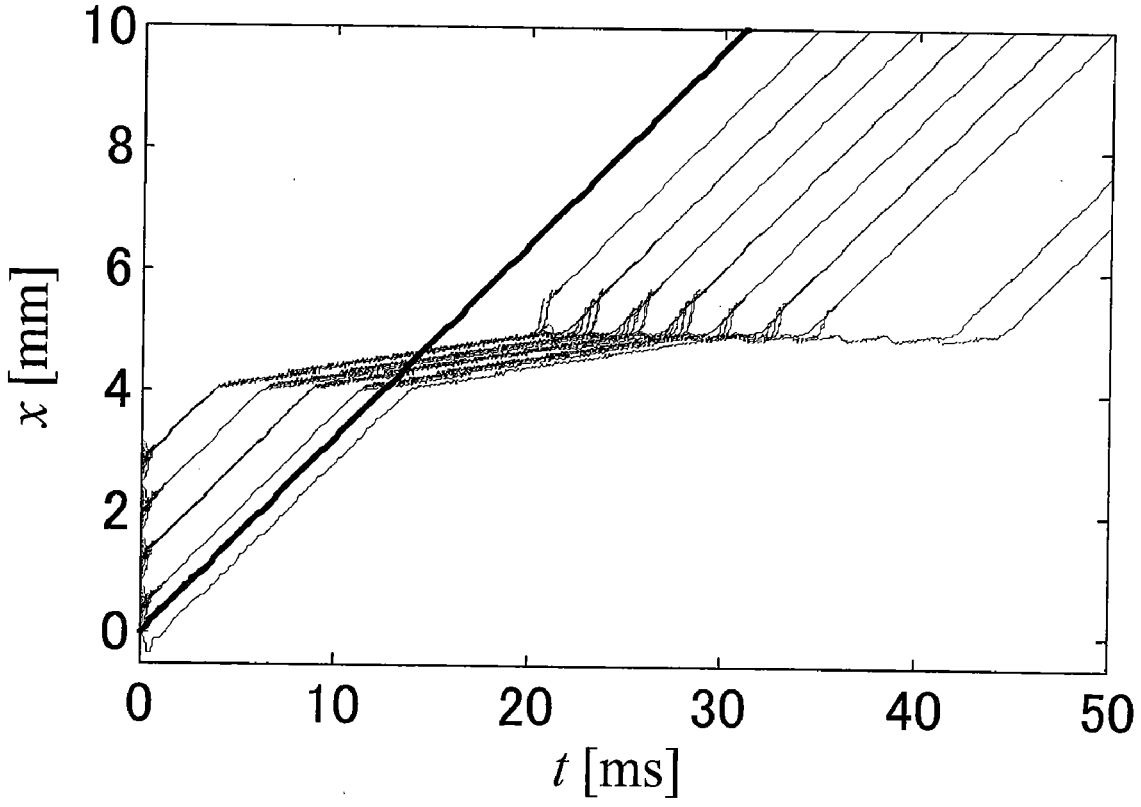
FIG. 6 is a graph chart showing behavior of toner according to the first embodiment.
Figure 7A:
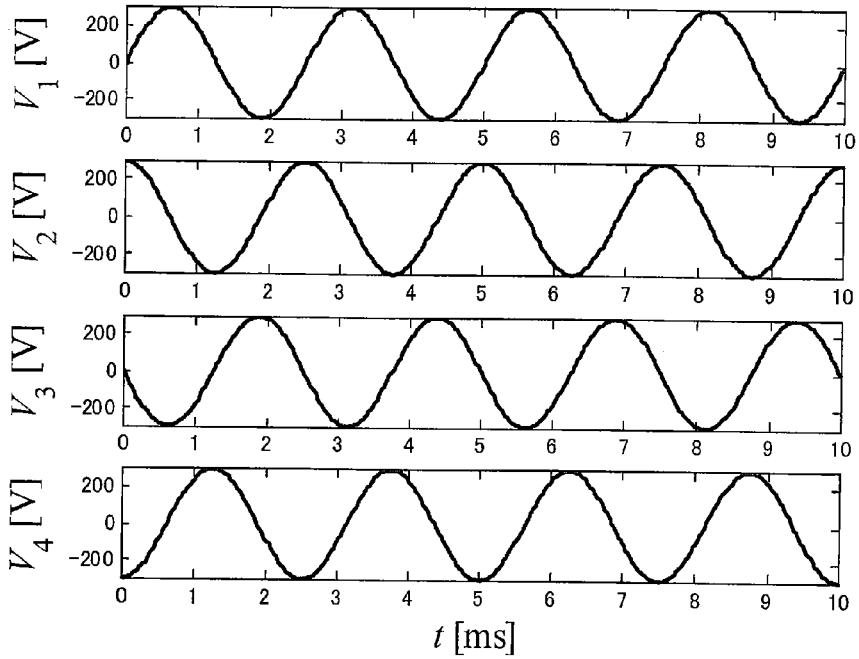
FIGS. 7A and 7B are waveform charts respectively showing waveforms of applied voltages according to the first embodiment.
Figure 7B:
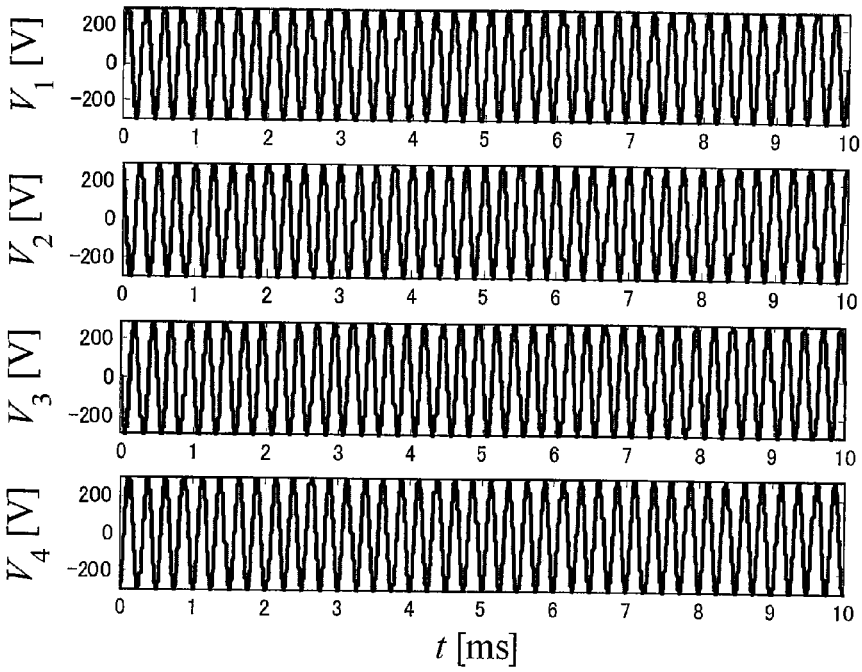

As shown in FIG. 6, the traveling velocity of the traveling wave electric field in the developing section is ten times faster than the velocity in the conveying section, under the above conditions. Nevertheless, the conveying velocity of the toner T in the developing section slows down and oscillates. Therefore, irregular density of the toner T caused by the traveling wave electric field is decreased in the developing section. That is, the toner T conveyed from left to right can be supplied to the photosensitive drum 5 with nearly equable density, in FIG. 5. Accordingly, a favorable image without irregular thickness can be formed onto the paper P. In the present embodiment, a length of the developing section in the toner conveying direction is set as 1 mm. However, the number of the linear electrodes 13 may be increased to elongate the length of the developing section, or the length of the respective electrodes may be shortened to reduce the length of the developing section.

Figure 8:
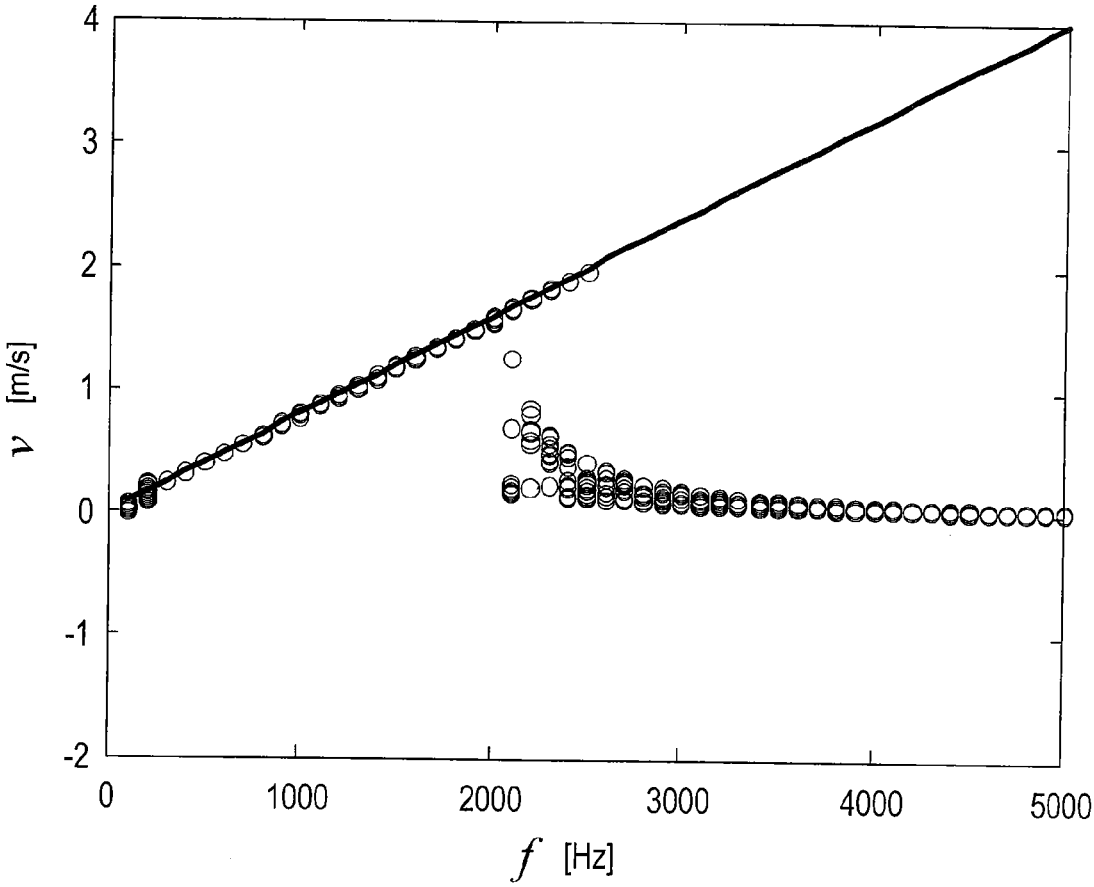
FIG. 8 is a graph chart showing change in conveying velocity of toner in case of up-conversion of frequency of the applied voltage.

Now, it will be explained how an up-conversion of the frequency f causes the following rate of the toner T to decrease. Assuming that $E_0=1.500$ [μV/m], a=10.0 [μm], $6.28\times10^{-15}$ [C], and $m=6.28\times10^{-13}$ [kg], the conveying velocity of the toner T (shown as circles) is consistent with the traveling velocity of the traveling wave electric field (shown as a linear line) when the frequency f is lower than 2 kHz, as shown in FIG. 8. Then the conveying velocity of the toner T becomes slower than the traveling velocity of the traveling wave electric field when the frequency f is around 2 kHz or above. In this manner, the frequency $f_d$ of the alternating voltages applied to the linear electrodes 13 in the developing section are set higher than the frequency $f_t$ of the alternating voltages applied to the linear electrodes 13 in the conveying section, so that irregular density of the toner T is decreased in the developing section. Since the frequency $f_d$ can be easily modified by circuit control, supply of the toner T to the photosensitive drum 5 can be optimized by changing the frequency $f_d$ in the developing section in accordance with the characteristics (such as chargeability and particle size) of the toner T.

Figure 9A:
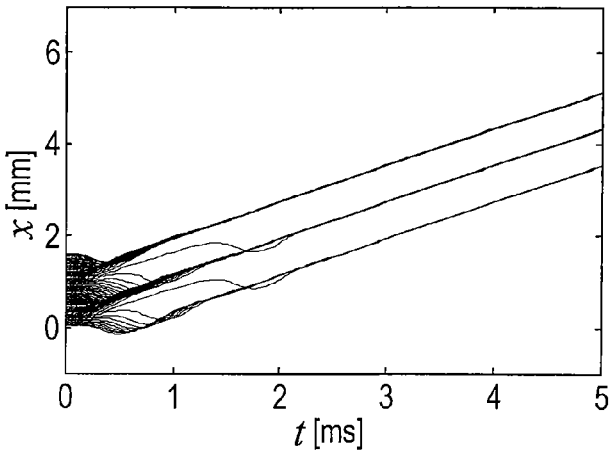
FIGS. 9A to 9C are graph charts respectively showing behavior of toner in various frequencies.
Figure 9B:
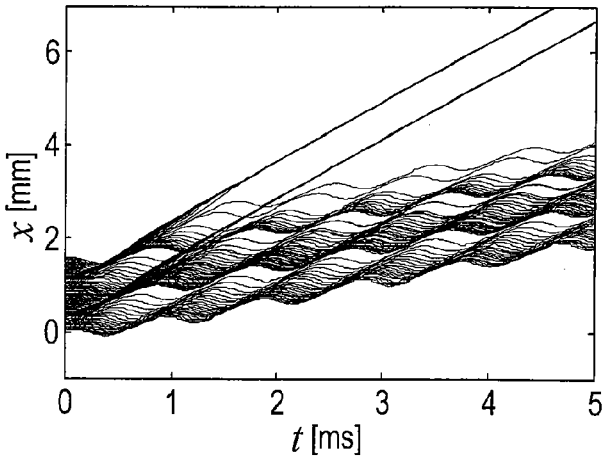
Figure 9C:
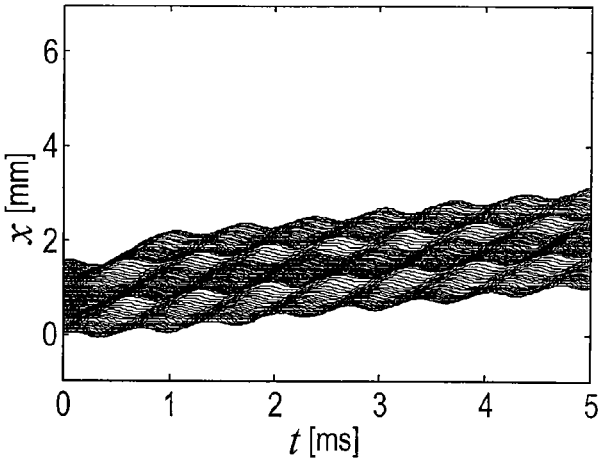

FIGS. 9A, 9B and 9C are graph charts respectively showing behavior of the toner T when the frequency f is 300 [Hz], 1,600 [Hz], and 1,800 [Hz], respectively, under the same conditions as in FIG. 4. As shown in FIGS. 9A to 9C, as the frequency of the traveling wave electric field is increased, the toner T is oscillatingly conveyed more slowly than the traveling velocity of the traveling wave electric field. Accordingly, irregular density of the toner T in the form of stripe pattern hardly occurs.

Figure 10A:
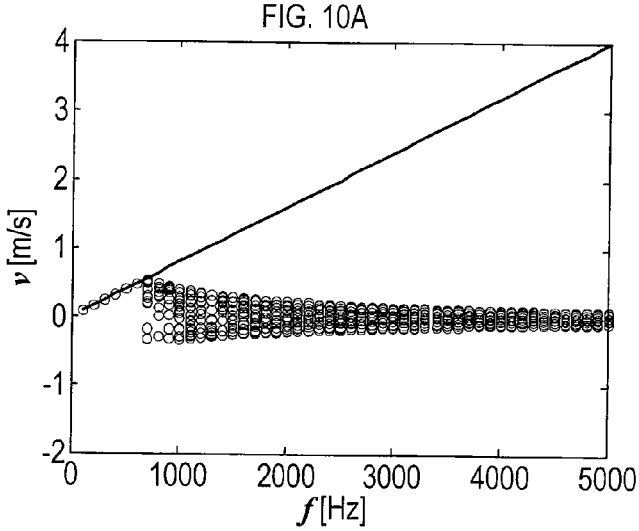
FIGS. 10A to 10C are graph charts showing a relationship between the conveying velocity of toner and traveling velocity of traveling wave electric field in various electric field intensities.
Figure 10B:
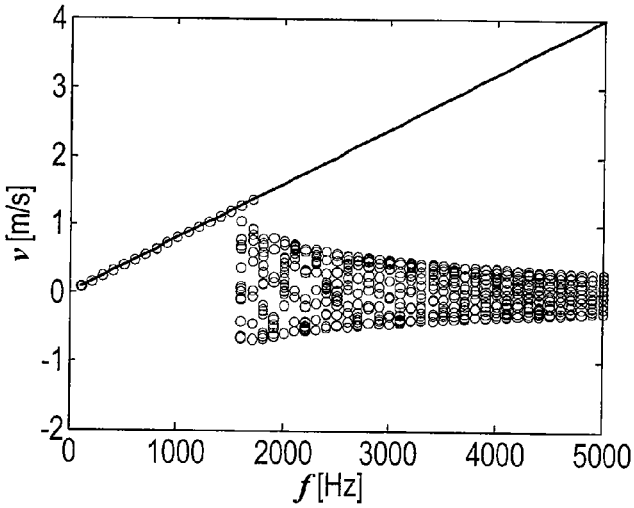
Figure 10C:
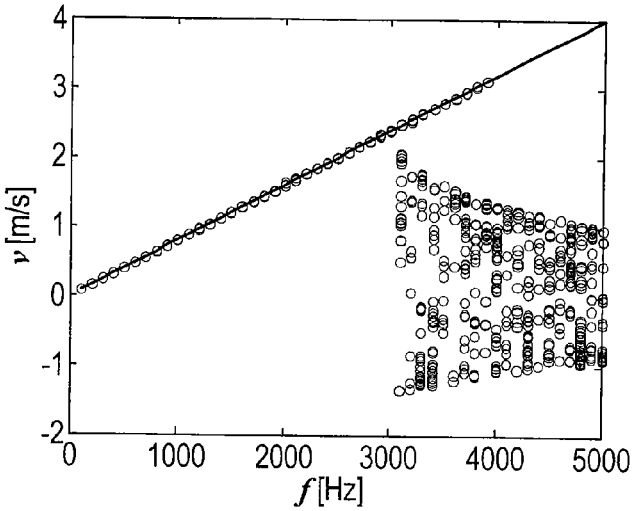

FIGS. 10A, 10B and 10C are graph charts respectively showing a relationship between the conveying velocity of the toner T and the traveling velocity of the traveling wave electric field. FIGS. 10A, 10B and 10C respectively show the cases when the field intensity E is $0.3\times10^6$ [V/m], $0.9\times10^6$ [V/m], and $3.0\times10^6$ [V/m]. As shown in FIGS. 10A to 10C, the stronger the field intensity E is, to the higher frequency the conveying velocity of the toner T can follow the traveling velocity of the traveling wave electric field. Also, a frequency limit at which the conveying velocity of the toner T is consistent with the traveling velocity of the traveling wave electric field can be expressed as follows, if assumed that the mass of the toner T is equal to zero (0).

$$f = \frac{qE_0}{6\pi\eta a}\frac{1}{\lambda} \tag{4}$$

Second Embodiment

Figure 11:
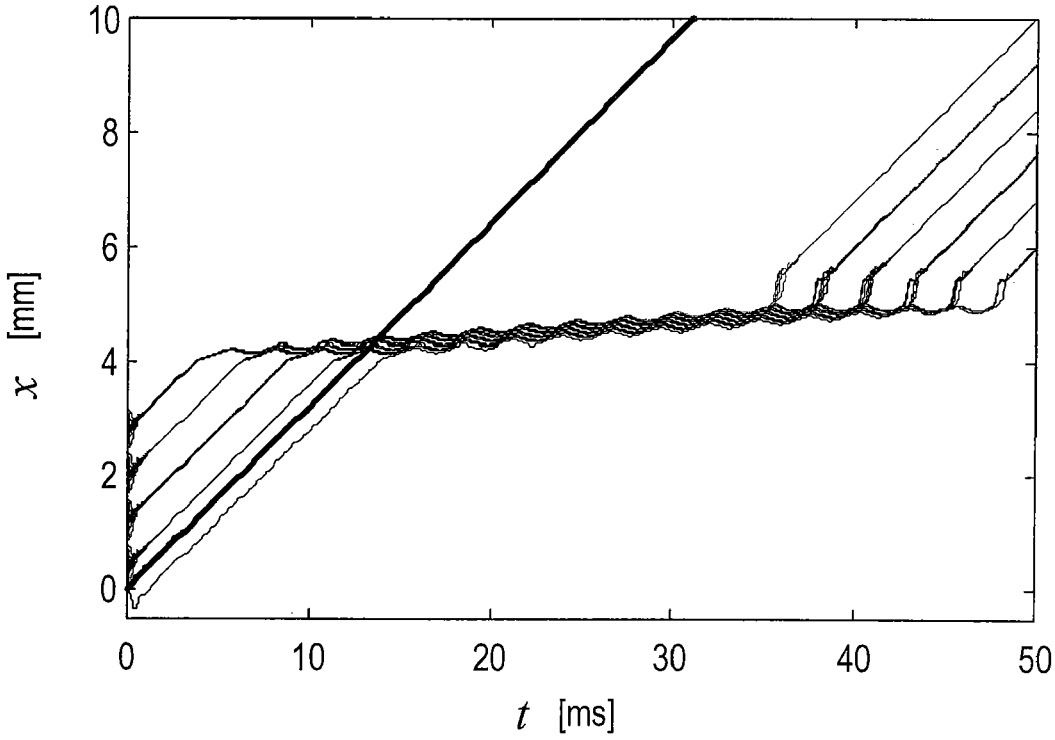
FIG. 11 is a graph chart showing behavior of toner according to the second embodiment.
Figure 12A:
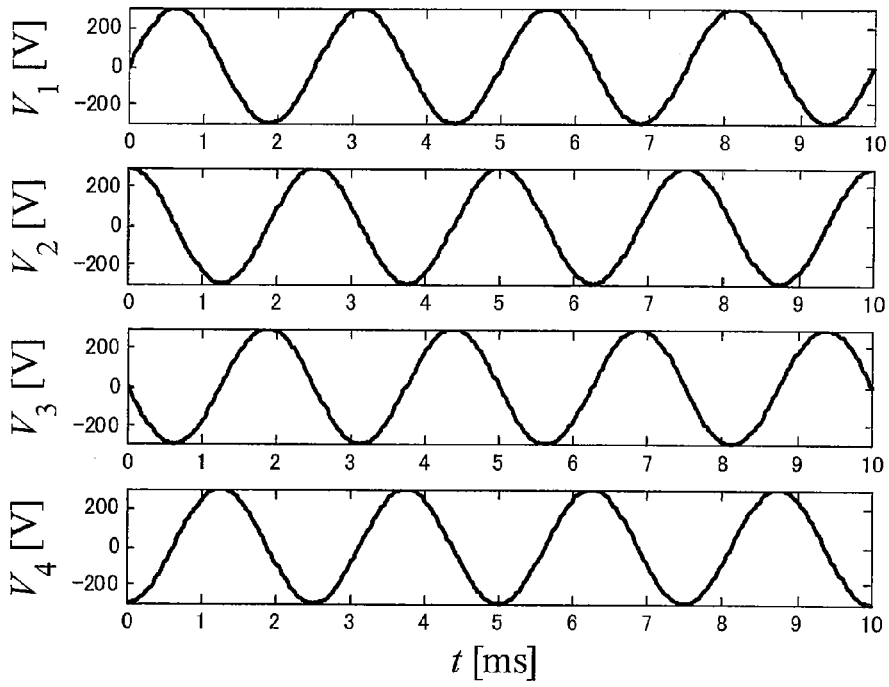
FIGS. 12A and 12B are waveform charts respectively showing waveforms of applied voltages according to the second embodiment.
Figure 12B:
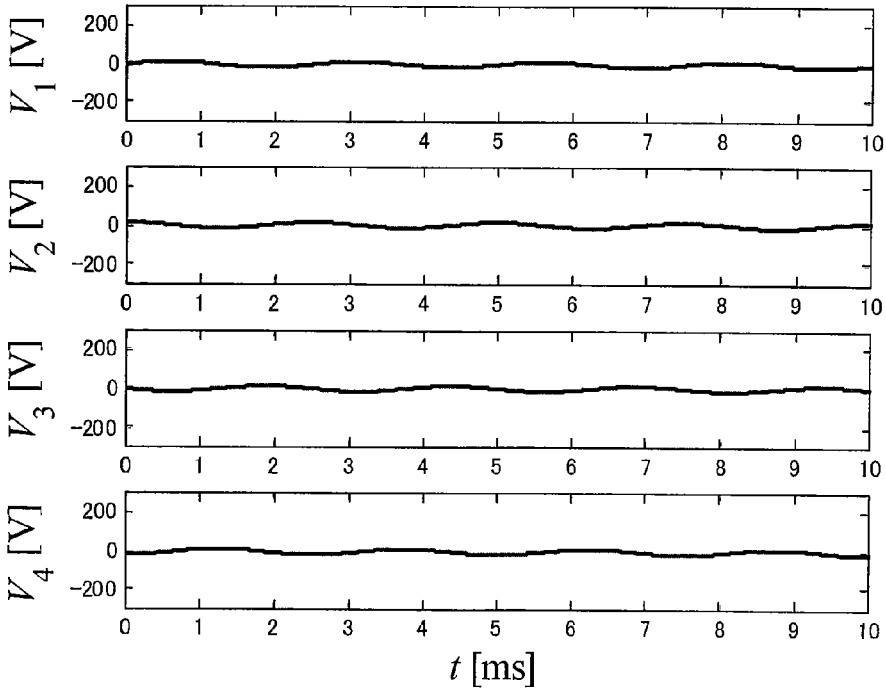

In the present embodiment, the above expressions (1) and (2) are calculated, assuming that $f_t=f_d=400$ [Hz], $V_t=300$ [V], and $V_d=15$ [V], using the same constitution as in the first embodiment shown in FIG. 5. FIG. 11 shows results of the calculation which indicate the behavior of the toner T. FIG. 12A is a waveform chart showing voltages applied to the conveying section under the above conditions. FIG. 12B is a waveform chart showing voltages applied to the developing section under the above conditions.

As shown in FIG. 11, under the above conditions as well, the field intensity acting on the toner T in the developing section is weakened. The conveying velocity of the toner T in the developing section slows down and oscillates. Thus, the conveying velocity of the toner T is no longer consistent with the traveling velocity of the traveling wave electric field. Accordingly, irregular density of the toner T conveyed from left to right is decreased in the developing section. The toner T can be supplied to the photosensitive drum 5 with nearly equable density. In this case as well, a favorable image without irregular thickness can be formed onto the paper P. Since the voltage $V_d$ can be easily modified by circuit control, supply of the toner T to the photosensitive drum 5 can be optimized by modifying the voltage $V_d$ in the developing section in accordance with the characteristics (such as chargeability and particle size) of the toner T.

Third Embodiment

Figure 13:
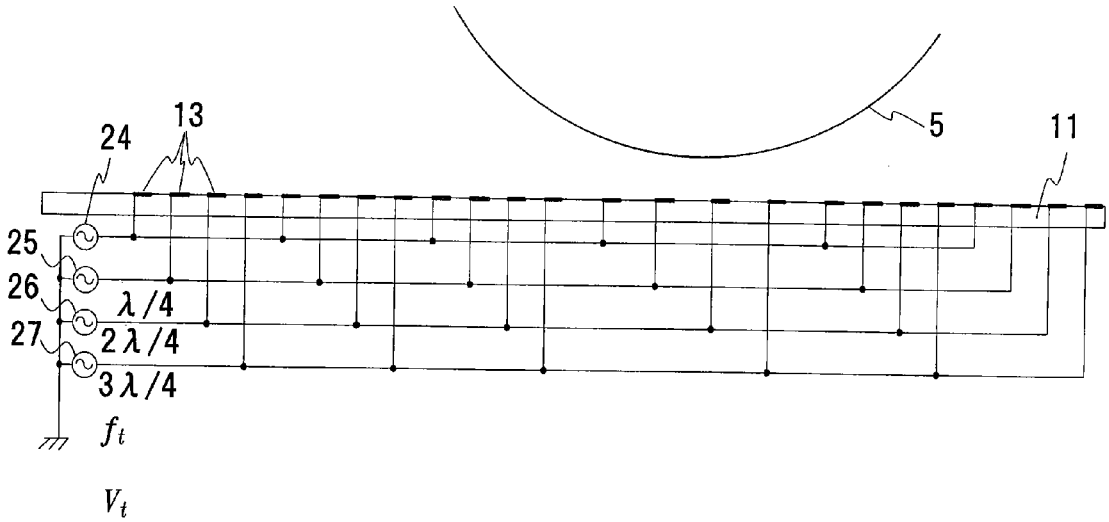
FIG. 13 is an explanatory view simplistically showing a mechanism of conveying toner according to a third embodiment.

Referring to FIG. 13, the intervals between the respective linear electrodes 13 provided on the conveying member 11 is broadened in the developing section, in a third embodiment. Alternating voltages (voltage $V_t$, frequency $f_t$, sine wave) as shown in FIG. 15 are applied to the linear electrodes 13 by the alternating current sources 24, 25, 26 and 27. The alternating voltages generated by the alternating current sources 24 to 27 are shifted in phase by 90° (π/2) in the order of the alternating current sources 24 to 27. Assuming that $V_t$=300 [V], $f_t$=400 [Hz], electric field wavelength in the conveying section=0.8 [mm], electric field wavelength in the developing section=2.4 [mm], interelectrode distance in the conveying section=0.2 [mm], interelectrode distance in the developing section=0.6 [mm], calculation results shown in FIG. 14 are obtained by calculating the above expressions (1) and (2).

Figure 14:
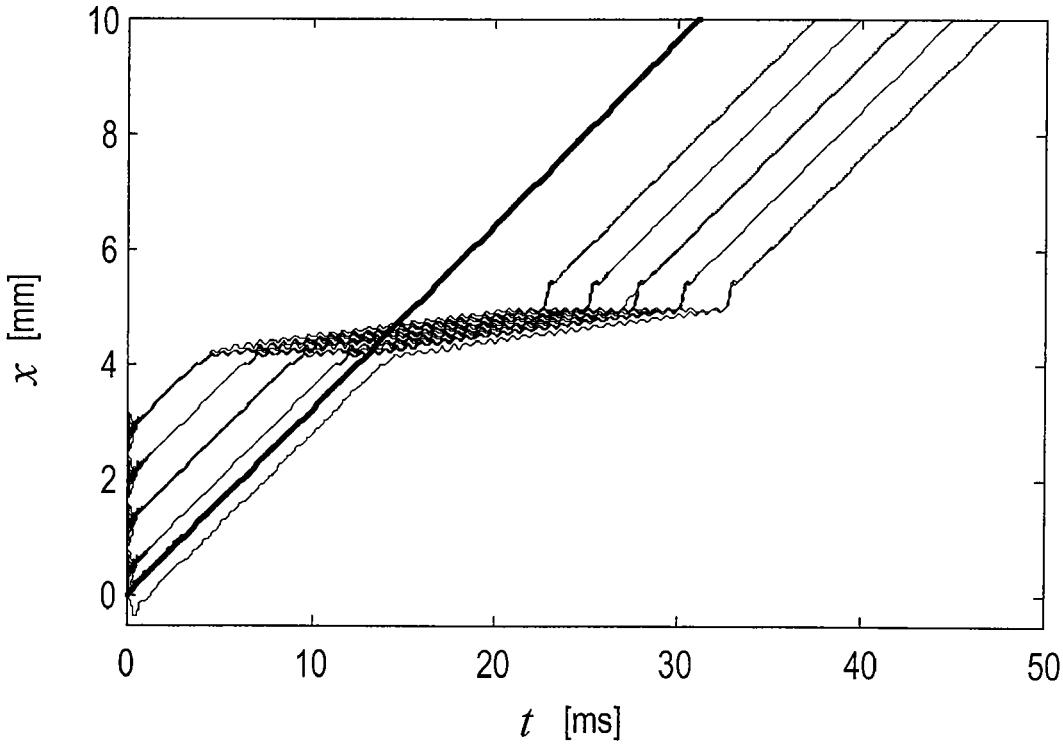
FIG. 14 is a graph chart showing behavior of toner according to the third embodiment.
Figure 15:
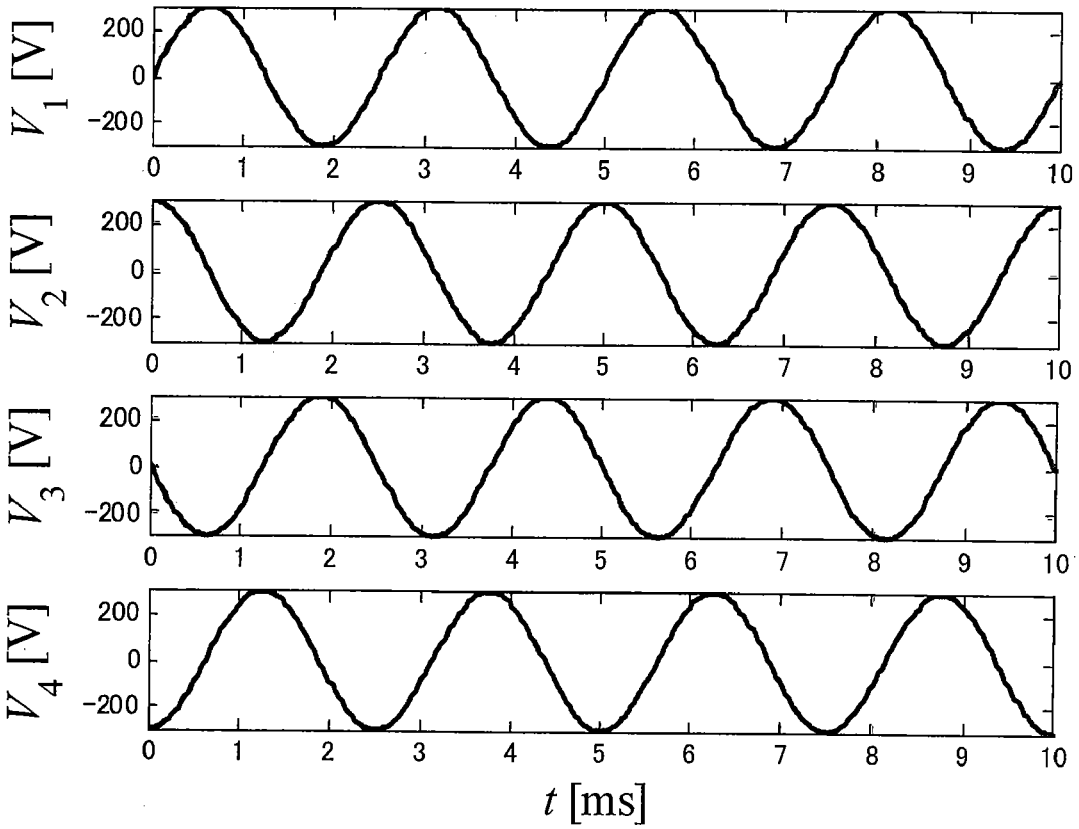
FIG. 15 is a graph chart showing waveforms of applied voltages according to the third embodiment.

As shown in FIG. 14, under the above conditions as well, the field intensity acting on the toner T in the developing section is weakened. The conveying velocity of the toner T in the developing section slows down and oscillates. Thus, the conveying velocity of the toner T is no longer consistent with the traveling velocity of the traveling wave electric field. Accordingly, irregular density of the toner T conveyed from left to right is decreased in the developing section. The toner T can be supplied to the photosensitive drum 5 with nearly equable density. In this case as well, a favorable image without irregular thickness can be formed onto the paper P. In the present embodiment, there is no necessity of providing the alternating current sources 34 to 37.

Therefore, the constitution of the laser printer 1 is simplified, and reduction in manufacturing costs can be achieved. In the present embodiment, since the field intensity acting on the toner T is changed by the intervals between the respective linear electrodes 13, the rate of change in the field intensity can be easily adjusted.

Fourth Embodiment

Figure 16:
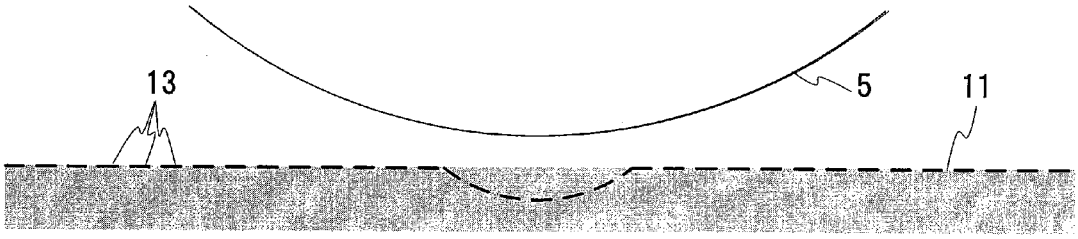
FIG. 16 is an explanatory view simplistically showing a mechanism of conveying toner according to a fourth embodiment.

Referring to FIG. 16, in order to weaken the field intensity acting on the toner T in the developing section, the linear electrodes 13 may be buried under the surface of the conveying member 11 in the developing section.

In this case as well, the field intensity is weakened as the intervals between a conveying path of the toner T and the respective linear electrodes 13 in the developing section expand. Accordingly, the conveying velocity of the toner T in the developing section slows down and oscillates. Thus, irregular density of the toner T is decreased. The toner T can be supplied to the photosensitive drum 5 with nearly equable density.

Here, if a voltage having a sin wave is applied to a linear electrode 13, the following Laplace equation and boundary condition calculate electric potential distribution where distance y>0. The distance y corresponds to a distance vertically upward from the linear electrode 13 to the conveying direction of the toner T.

$$\frac{\partial^2 V}{\partial x^2} + \frac{\partial^2 V}{\partial y^2} = 0 \quad (5)$$

where $y > 0, -\infty < x < \infty$ $$V(x, 0) = V_0 \sin[k(x - \lambda f t)] \quad (6)$$

From the above, an electric potential V can be defined as follows.

$$V(x, y) = -V_0 \exp(-ky)\cos[(k(x-\lambda \mathrm{ft})] \quad (7)$$

The field intensity E acting in the conveying direction of the toner T can be defined as follows.

$$E_x(x, y) = -\frac{dV}{dx} = -kV_0 \exp(-ky)\sin[k(x - \lambda f t)] \quad (8)$$

That is, the field intensity acting on the toner T in the conveying direction of the toner T is exponentially weakened as the intervals between the conveying path of the toner T and the linear electrodes 13 expand.

Accordingly, in the present embodiment, the toner T can be supplied to the photosensitive drum 5 with nearly equable density to form a favorable image onto the paper P without irregular thickness. Also in the present embodiment, the rate of change in the field intensity can be easily adjusted, as the field intensity is changed by the intervals between the respective linear electrodes 13 and the actual conveying path of the toner T.

Fifth Embodiment

Figure 17:
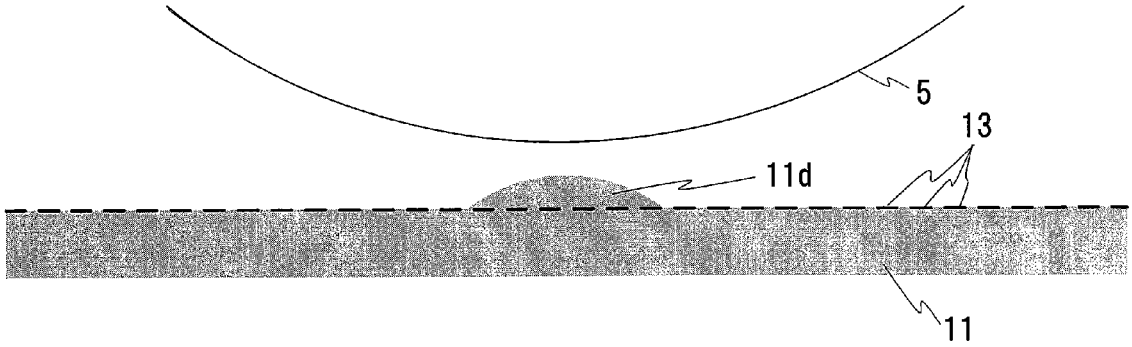
FIG. 17 is an explanatory view simplistically showing a mechanism of conveying toner according to a fifth embodiment.

Referring to FIG. 17, in order to expand the intervals between the actual conveying path of the toner T and the respective linear electrodes 13 in the developing section, a semicylindrical projection 11*d* may be provided over the linear electrodes 13 in the developing section of the conveying member 11. In this case, since the toner T is conveyed on the surface of the projection 11*d*, the intervals between the actual conveying path of the toner T set on the surface of the projection 11*d* and the respective linear electrodes 13 expand in the developing section. Thus, the same working effects as in the fourth embodiment can be achieved.

Sixth Embodiment

Figure 18:
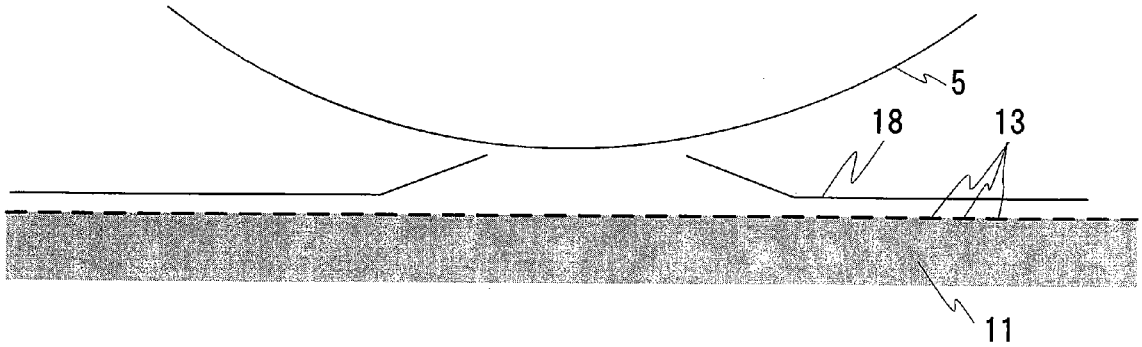
FIG. 18 is an explanatory view simplistically showing a mechanism of conveying toner according to a sixth embodiment.

Referring to FIG. 18, a windproof cover 18 which opens in the developing section is provided over the surface of the conveying member 11 in the present embodiment. The interval between the windproof cover 18 and the surface of the conveying member 11 expands more in the vicinity of the developing section than the interval in the conveying section. Therefore, air resistance acting on the toner T is increased in the developing section. The conveying velocity of the toner T can be inconsistent with the traveling velocity of the traveling wave electric field.

That is, airflow occurs in a space formed between the conveying member 11 and the windproof cover 18 as the toner T is conveyed. However, since the cross section of the space becomes large in the vicinity of the developing section, the airflow is decreased in velocity and the air resistance acting on the toner T is increased. As a result, the conveying velocity of the toner T is no longer consistent with the traveling velocity of the traveling wave electric field in the developing section. Irregular density of the toner T is decreased, and thus the toner T can be supplied to the photosensitive drum 5 with nearly equable density. Accordingly, in this case as well, a favorable image without irregular thickness can be formed onto the paper P. Moreover, an influence of turbulence in the airflow by the other members such as rollers can be eliminated by the windproof cover 18. The toner T can be conveyed with more equable density than in the first to fifth embodiments.

Various constitutions can be considered to increase the resistance acting on the toner T moving in the developing section, other than the above constitution in which the air resistance is changed. For example, rolling friction acting on the toner T may be increased in the developing section as compared to the conveying section.

In this case, the surface of the conveying member 11 in the developing section may be finished in such a manner as to be rough as compared to the surface of the conveying member 11 in the conveying section, for example. The conveying velocity of the toner T can be inconsistent with the traveling velocity of the traveling wave electric field by extremely simple processing.

Accordingly, reduction in manufacturing costs of the laser printer 1 can be favorably achieved.

Other Embodiments

The present invention is not limited to the above described embodiments. The present invention can be practiced in various manners without departing from the technical scope of the invention.

Figure 19:
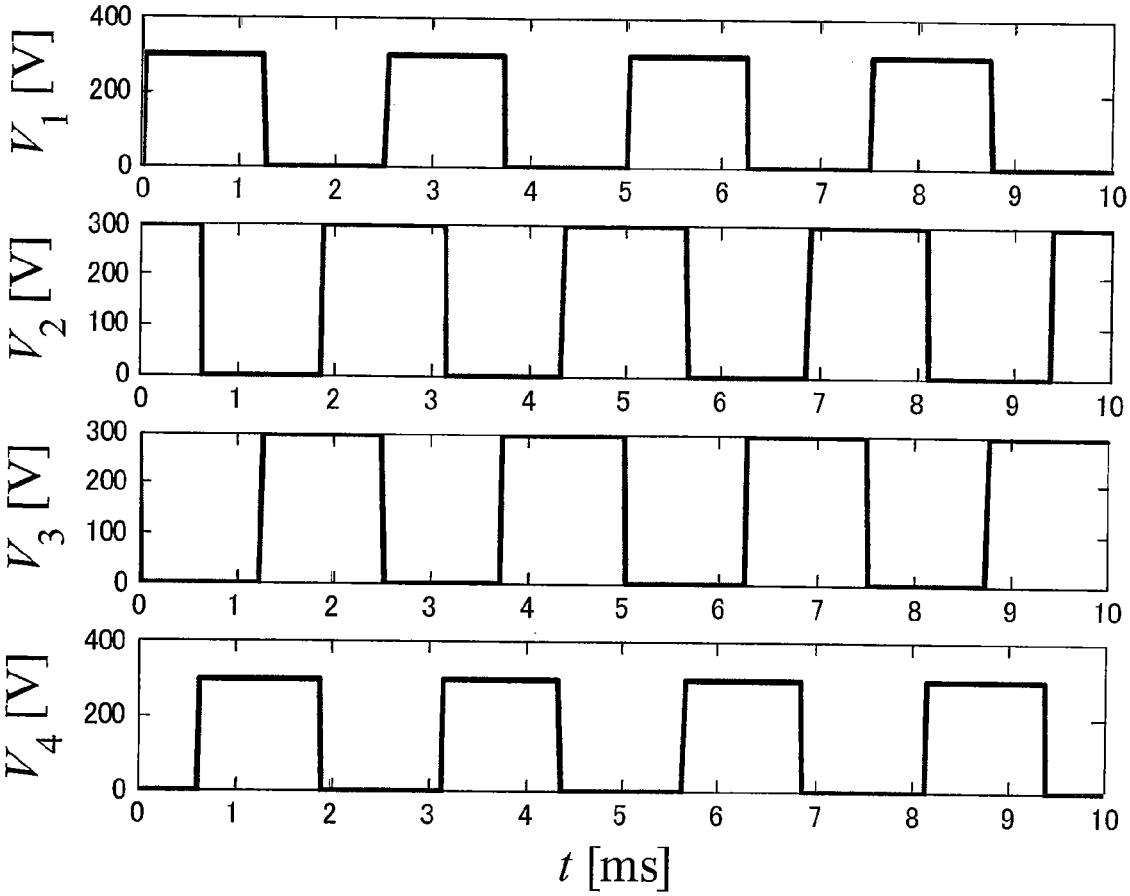
FIG. 19 is a waveform chart showing waveforms of applied voltages in a variation.

For instance, the voltage to be applied to the linear electrodes 13 may have a rectangular waveform as illustrated in FIG. 19, or other waveforms such as a saw-toothed waveform and the like.

Also, the waveforms of the alternating voltages applied to the linear electrodes 13 provided in the conveying section and the waveforms of the alternating voltages applied to the linear electrodes 13 provided in the developing section may be different from each other. For example, while alternating voltages having sine waveforms are applied to the linear electrodes 13 in the conveying section, alternating voltages having rectangular waveforms may be applied to the linear electrodes 13 in the developing section.

Also, the conveying member 11 may be adapted to change the following rate of the toner T by accelerating the conveying velocity of the toner T in the developing section. For example, the intensity of the electric field in the developing section may be set stronger than the intensity of the electric field in the conveying section, while the frequency of alternating voltage in the developing section may be set higher than the frequency of alternating voltage in the conveying section. Or, an air flow in the same direction as the conveying direction of the toner T may be generated by a movable member like a rotor. Then, the air flow may be lead to the developing section.

Also, the developing section may be provided upstream in the conveying direction of the toner T than a section facing the photosensitive drum 5 of the conveying member 11.

Also, the photosensitive drum 5 may be a belt in shape or may be not photosensitive, i.e., of type in which an electrostatic latent image is formed in a manner other than exposition to light. Various other types of photosensitive drum 5 (i.e., carrier) may be provided. For example, the present invention may be applied to an image forming apparatus of a so-called toner-jet type. Then, the carrier is a recording medium. The present invention may be also applied to the other various types of developer conveying device like the one that conveys a developer in an image forming apparatus which uses microcapsule paper.

What is claimed is:

1. A developer conveying device comprising:

a first guide member that forms a first section of a conveying path of a charged developer;

a second guide member that forms a second section of the conveying path which continues from the first section; and a plurality of electrodes arranged on the first guide member and the second guide member, the plurality of electrodes generating a traveling wave electric field which conveys the charged developer along the conveying path, wherein a following rate at which the developer follows travel of the traveling wave electric field in the second section is different than the following rate in the first section, and wherein the following rate in the second section is slower than the following rate in the first section.

2. The developer conveying device according to claim 1, wherein the second section faces a carrier that carries the developer.

3. The developer conveying device according to claim 1, wherein a first varying voltage applied to the electrodes provided on the first guide member has a lower frequency than a second varying voltage applied to the electrodes provided on the second guide member.

4. The developer conveying device according to claim 3, wherein at least one of the first varying voltage and the second varying voltage has a sine waveform.

5. The developer conveying device according to claim 3, wherein at least one of the first varying voltage and the second varying voltage has a rectangular waveform.

6. The developer conveying device according to claim 1, wherein intensity of the traveling wave electric field in the second section is smaller than the intensity of the traveling wave electric field in the first section.

7. The developer conveying device according to claim 1, wherein a first varying voltage applied to the electrodes provided on the first section has a larger maximum value than a second varying voltage applied to the electrodes provided on the second section.

8. The developer conveying device according to claim 7, wherein at least one of the first varying voltage and the second varying voltage has a sine waveform.

9. The developer conveying device according to claim 7, wherein at least one of the first varying voltage and the second varying voltage has a rectangular waveform.

10. The developer conveying device according to claim 1, wherein the electrodes provided on the second guide member has larger intervals therebetween than the electrodes provided on the first guide member.

11. The developer conveying device according to claim 1, wherein a distance between the electrodes provided on the second guide member and the conveying path in the second section is larger than a distance between the electrodes provided on the first guide member and the conveying path of the first section.

12. The developer conveying device according to claim 1, wherein resistance acting on the developer in the second section is larger than the resistance acting on the developer in the first section.

13. The developer conveying device according to claim 12, wherein the resistance corresponds to air resistance.

14. The developer conveying device according to claim 12, wherein the resistance corresponds to rolling friction.

15. An image forming apparatus including:

the developer conveying device according to claim 1;

a carrier on which an electrostatic latent image is formed, and a transfer device that transfers a developer supplied to the carrier to a recording medium.

* * * * *